US006437494B1

(12) United States Patent
Inayoshi

(10) Patent No.: US 6,437,494 B1
(45) Date of Patent: Aug. 20, 2002

(54) DIELECTRIC BARRIER DISCHARGE LAMP

(75) Inventor: Sadatoshi Inayoshi, Kanagawa-ken (JP)

(73) Assignee: M.D. Com Inc. (JP)

( * ) Notice: Subject to any disclaimer, the term of this patent is extended or adjusted under 35 U.S.C. 154(b) by 0 days.

(21) Appl. No.: 09/450,909

(22) Filed: Nov. 29, 1999

(30) Foreign Application Priority Data

Dec. 1, 1998 (JP) ..... 10-341995

(51) Int. Cl.[7] ..... H01J 21/00

(52) U.S. Cl. ..... 313/234; 313/594; 313/601; 313/607; 313/355

(58) Field of Search ..... 313/594, 601, 313/607, 294, 355

(56) References Cited

FOREIGN PATENT DOCUMENTS

| | | |
|---|---|---|
| JP | 6-231733 | 8/1994 |
| JP | 6-310102 | 11/1994 |

*Primary Examiner*—Vip Patel
(74) *Attorney, Agent, or Firm*—Ostrolenk, Faber, Gerb & Soffen, LLP

(57) ABSTRACT

At the outer boundary of a discharge container 1, a pair of opposed electrodes 3*a* and 4*a* and a pair of opposed electrodes 3*b* and 4*b* are disposed with a specified spacing being given between them, and to each pair of opposed electrodes, a high-frequency voltage is applied from a high-frequency, high-voltage power supply 8 through a limiting resistor 6*a*, 7*a*, and a limiting resistor 6*b*, 7*b*. Across each pair of opposed electrodes, a steamer of discharge plasma corresponding to the amperage of the discharge current is generated, however, by adjusting the resistance value of the above-mentioned limiting resistor 6*a*, 7*a*, and the resistance value of the limiting resistor 6*b*, 7*b*, the discharge current is appropriately set, and thus the streamers of discharge plasma generated across the pairs of opposed electrodes are made uniform. Because the pair of opposed electrodes is disposed eccentrically with respect to the axis of the discharge container 1, a creeping discharge can be developed on the inside wall in the vicinity of the electrodes or over the entire path of discharge, resulting in the "fluctuation" of the streamer being suppressed.

6 Claims, 2 Drawing Sheets

DIELECTRIC BARRIER DISCHARGE LAMP

BACKGROUND OF THE INVENTION

1. Field of the Invention

The present invention relates to a dielectric barrier discharge lamp, particularly to a dielectric barrier discharge lamp with which the position of a generated streamer of discharge plasma is fixed.

2. Description of the Prior Art

Up to now, this type of dielectric barrier discharge lamp has been used as an ultraviolet light source for exciting a fluorescent material so as to fluoresce, etc. in various fields of technology. For the dielectric barrier discharge lamp, a variety of techniques have been proposed up to now which intend to provide an increased luminance of output light, elimination of the variation in luminance in the radiation area, stabilization to suppress the deterioration of the luminance with time, a higher efficiency to increase the total quantity of radiation per unit input power, an extended service life, simplification of the construction, facilitation of the manufacture, reduction in cost, etc. by generating a number of almost uniformly distributed thin streamers of discharge plasma in the space across the discharge electrodes, which are said to be characteristic of the dielectric barrier discharge lamp.

An embodiment of prior art as given in Japanese Unexamined Patent Publication No. 6 (1994) 231733 (called a first embodiment of prior art) provides a dielectric barrier discharge lamp with which the discharge container is filled with a discharge gas to form excimer molecules by dielectric barrier discharge, and a window member to take out the light radiated from the excimer molecules generated by the dielectric barrier discharge is provided. For this first embodiment of prior art, it is proposed that the content of OH group in the silica glass used for the window member should be decreased to under 10 ppm by weight. Generally, with dielectric barrier discharge lamps, the silica glass used as the window member to take out the light to the outside of the discharge container is deteriorated, being eroded by the halogen with the lapse of on-time. For this first embodiment of prior art, it is stated that, by restricting the amount of OH group contained in the silica glass, the erosion of the silica glass by the halogen is suppressed, therefore the reduction in output light intensity resulting from the erosion is suppressed, and the decrease in density of the excimer molecules containing halogen can be prevented.

For a dielectric barrier discharge lamp according to an embodiment of prior art as proposed in Japanese Unexamined Patent Publication No. 6 (1994)-310102 (called a second embodiment of prior art), it is stated that, by configuring one of the opposed electrodes as a conductive net; specifying the thickness of the conductive wires constituting the conductive net for the electrode provided in the light-permeable dielectric in the window opening to take out light to be 0.2 mm or less; and specifying the area of one mesh in the conductive net to be a value between 0.04 and 2.5 $mm^2$, the radiation output efficiency can be improved and the light output can be stabilized.

However, generally, with dielectric barrier discharge lamps, when they are in radiation, the thin streamers of discharge plasma generated in the space across the discharge electrodes constantly move at a low speed, and if the luminance is measured at a given point in the window (made of silica glass) in the discharge container, the luminance offers a "fluctuation" with time. With conventional dielectric barrier discharge lamps, this "fluctuation" has been an essential problem which cannot be avoided. In addition, to generate more thin streamers at discharge plasma in the space across the discharge electrodes stably, the material, the construction, etc. of the dielectric barrier discharge lamp must meet more requirements, which presents a problem of that meeting the requirements increases the manufacturing cost. For the above-stated conventional dielectric barrier discharge lamps, solutions to these problems have not always been clearly indicated.

The above-stated conventional dielectric barrier discharge lamps have a disadvantage of that the movement of the streamers in radiation output causes the luminance in the light output window to have a "fluctuation" with time, and this "fluctuation" of the luminance cannot be prevented. In addition, if more streamers are to be generated stably in order to lower the degree of "fluctuation" of the luminance, the number of requirements to be met by the material and the construction is increased, and with this increase in the number of requirements, the manufacturing cost is inevitably increased.

The present invention offers the following means to solve the above-stated problems.

(1) A dielectric barrier discharge lamp comprising a cylindrical discharge container which permeates ultraviolet radiation, a discharge gas sealed in the discharge container, and a pair of discharge electrodes provided at the outside surface of the discharge container with the end portions being in contact with it, in which the end portions of two discharge electrodes constituting the pair of electrodes are opposed to each other across a discharge spacing; the line connecting the ends of the two electrodes to each other is eccentric from, i.e., offset relative to the axis of the discharge container; and a plane perpendicular to the line joining the electrodes is roughly parallel to the axis of the container.

(2) A dielectric barrier discharge lamp as above, in which a stream of discharge plasma generated across the pair of discharge electrodes takes a shape, when viewed from the direction of the axis which, so that at least in portion, it is bent toward the inside wall of the discharge container.

(3) A dielectric barrier discharge lamp as above, in which a current limiting resistor is inserted in series with the pair of discharge electrodes.

As stated above, by providing a pair of opposed electrodes eccentrically (offset) with respect to the axis of the discharge container, the position of the stream of discharge plasma generated in the discharge container can be stabilized, and thus the "fluctuation" of the luminance distribution on the ultraviolet radiation receiving surface can be suppressed.

SUMMARY OF THE INVENTION

The purpose of the present invention is to offer a dielectric barrier discharge lamp with which occurring of a "fluctuation" of the luminance distribution on the ultraviolet radiation receiving surface can be suppressed, and yet the construction is simple.

The elements of the invention are:

1 Discharge container

2 Gas

3, 3*a*, 3*b*, 4, 4*a*, 4*b* Opposed electrode

5, 5*a*, 5*b* Streamer

6, 6*a*, 6*b*, 7, 7*a*, 7*b* Limiting resistor

8 High-frequency high-voltage power supply

DESCRIPTION OF THE PREFERRED EMBODIMENT

An embodiment of the present invention will be explained with reference to the drawings.

With a dielectric barrier discharge lamp according to an embodiment of the present invention which outputs ultraviolet radiation by the dielectric barrier discharge occurring in a discharge container. The discharge container is formed as a cylindrical container in the form of a cylinder which has permeability to the ultraviolet radiation in addition to the function as a dielectric barrier; in the discharge container, discharge gas which excites and forms excimer molecules is sealed; and N sets of pair of opposed electrodes (the N denotes an integer of greater than 1) are disposed at the outer boundary of the discharge container in the eccentric position with respect to the cross-sectional geometry of the discharge container along the cylinder of the discharge container with a specified spacing being given between sets of pair of opposed electrodes.

To inspect the fluorescent screen for a plasma display used with a television set, a testing device to determine the luminescence distribution for the fluorescent screen has been put to practical use. As the ultraviolet light source, the dielectric barrier discharge lamp has been adopted. To determine the luminescence distribution for the fluorescent screen with high accuracy, an ultraviolet light source which radiates ultraviolet radiation at a luminance stable over a sufficiently long period of time has been demanded. With conventional dielectric barrier discharge lamps, as stated above, it has not been able to avoid that a "fluctuation" in luminance distribution is caused on the light receiving surface, resulting from the streamers of discharge plasma being slowly moved.

Figure 1:
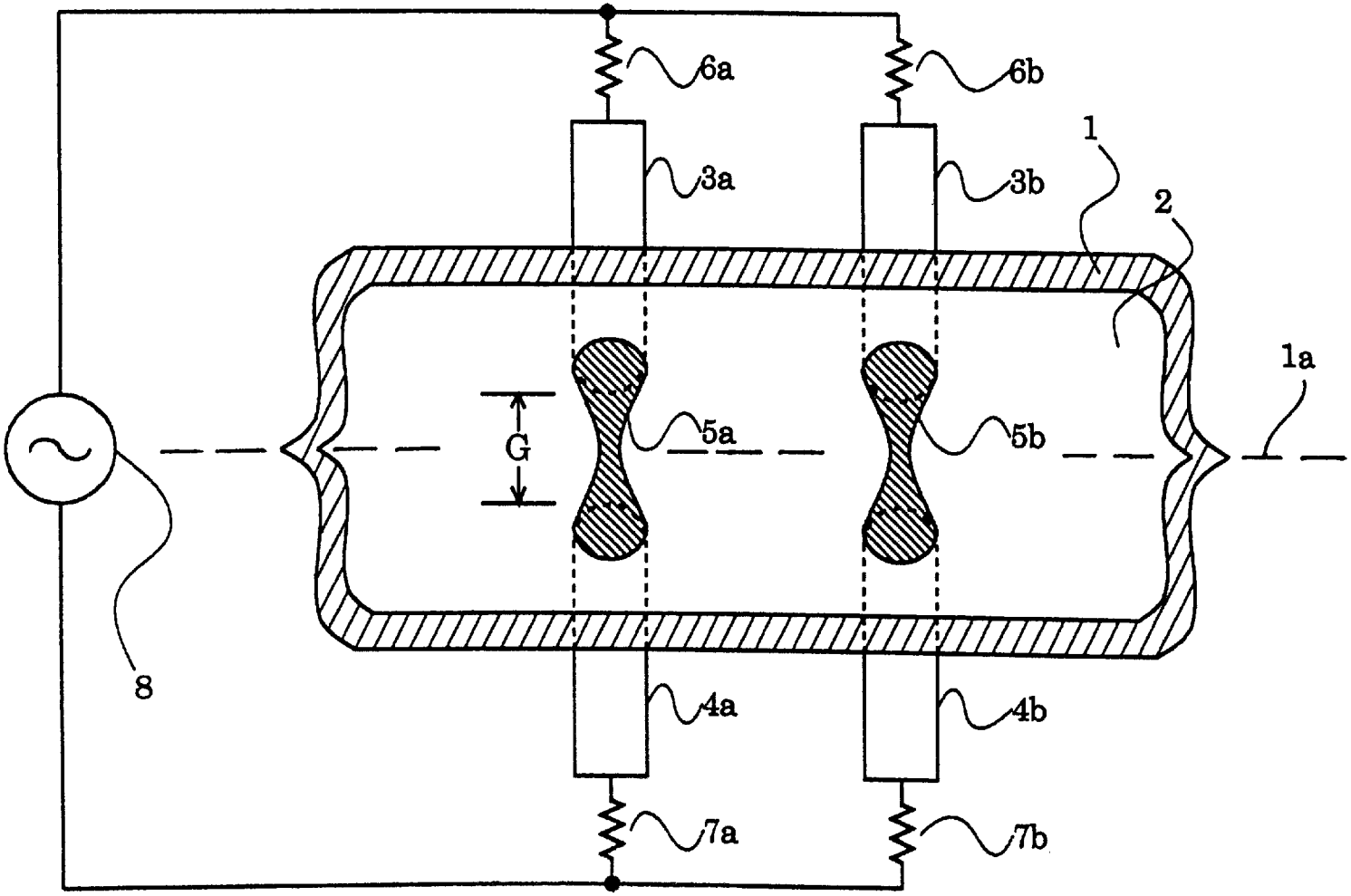
FIG. 1 shows a sectional view taken along the axis of the cylindrical tube of a discharge container according to an embodiment of the present invention together with a power supply circuit.
Figure 2:
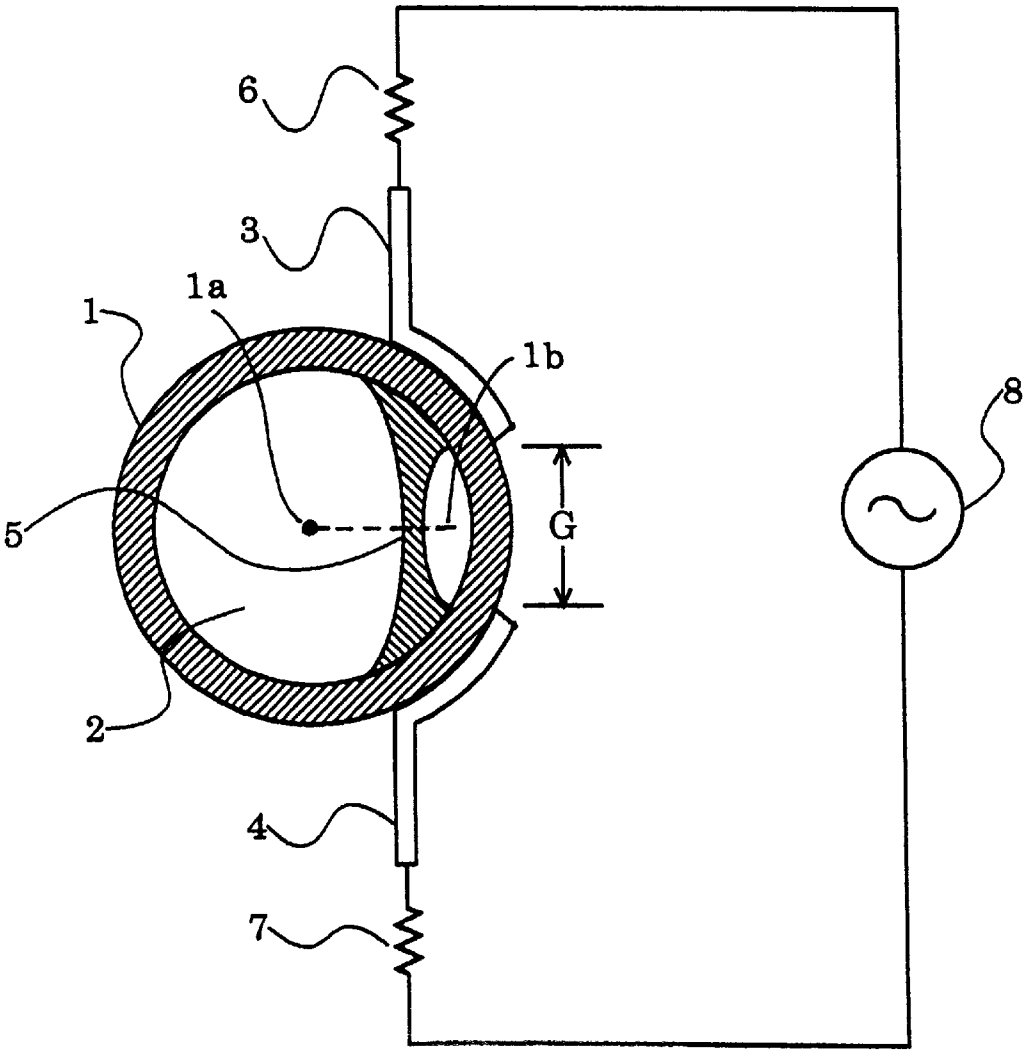
FIG. 2 shows a sectional view taken along a plane perpendicular to the axis of the cylindrical tube of a discharge container according to the embodiment as shown in FIG. 1 together with a power supply circuit.

FIG. 1 shows a sectional view of a cylindrical discharge container according to the present embodiment (an example of the above-mentioned N being 2). Naturally and inherently, since the container 1 is cylindrical, it has a longitudinal axis 1*a*. See FIG. 1 and FIG. 2. This sectional view is a view of a surface which is obtained when the discharge container is cut by a plane passing through the axis of the cylindrical tube of discharge container, from the direction perpendicular to the cut surface. FIG. 2 shows a sectional view taken along a plane perpendicular to the axis 1*a* of the cylindrical tube of the discharge container according to the embodiment as shown in FIG. 1. In these figures, the resistors and the power supply are shown by means of a circuit diagram rather than by sectional view.

As shown in FIG. 1 and FIG. 2, at the outer boundary of the discharge container 1 according to the present embodiment, two sets of pair of opposed electrodes comprising a first set of opposed electrodes 3*a* and 4*a* and a second set of opposed electrodes 3*b* and 4*b* are provided. These pairs of opposed electrodes are disposed with a spacing of approx. 3 cm being given between them along the direction of the axis of the tube of the discharge container 1, being mounted to the structural member (not shown) of the lamp holder with the end portion being in contact with the circumference of the outer boundary of the discharge container 1. The gap between the electrodes which is indicated with a symbol G in the figure is approx. 4 mm.

To the opposed electrodes 3*a* and 4*a*, and the opposed electrodes 3*b* and 4*b* is applied a high-frequency voltage from a high-frequency high-voltage power supply 8 through limiting resistors 6*a* and 7*a*, and limiting resistors 6*b* and 7*b*, respectively. With the high-frequency voltage being applied, a stream of plasma discharge corresponding to the amperage of discharge current across the electrodes is generated across the pair of opposed electrodes. For a given distance G across the pair of opposed electrodes, the effective area of the opposed electrodes which are contacted with the discharge container 1 is the primary factor defining the amperage of the discharge current. When two sets of pair of opposed electrodes are to be disposed, the above-mentioned limiting resistors 6*a* and 7*a* are connected to the opposed electrodes 3*a* and 4*a*, and the limiting resistors 6*b* and 7*b* are connected to the opposed electrodes 3*b* and 4*b*, as shown in FIG. 1, to adjust the amperage of the discharge current for each set of pair of opposed electrodes so that the streamers of discharge plasma are uniform.

In FIG. 2, to simplify the drawing expression, the opposed electrodes 3*a* and 3*b* are representatively expressed as the opposed electrode 3; the opposed electrodes 4*a* and 4*b* as the opposed electrode 4; the limiting resistors 6*a* and 6*b* as the limiting resistor 6; the limiting resistors 7*a* and 7*b* as the limiting resistor 7; and the streamers 5*a* and 5*b* as the streamer 5.

With the present embodiment, as shown in FIG. 2, the opposed electrodes 3*a* and 4*a*, and the opposed electrodes 3*b* and 4*b* are disposed in contact with the outer boundary of the discharge container 1 having a circular section in the position where they are eccentric with respect to the axis of the discharge container. By thus disposing the pair of opposed electrodes eccentrically, i.e. not diametrically opposed, with respect to the axis of the discharge container 1, a creeping discharge can be developed across the opposed electrodes 3*a* and 4*a*, and across the opposed electrodes 3*b* and 4*b*. In other words, the electrodes do not lie diametrically opposed to one another. Thus, an imaginary line connecting the electrodes lies to one side of and does not pass through the axis 1*a* of the container. This creeping discharge occurs in the region which extends along the inside surface of the discharge container 1, starting from the vicinity of the electrode end, and traverses across the opposed electrodes. By providing the pair of opposed electrodes eccentrically with respect to the axis of the discharge container 1, the stream generated across the pair of opposed electrodes is disposed toward the inside surface of the discharge container 1, in other words, the streamer takes a shape which would be given if it were pulled by the inside surface, and the position of it is fixed. Moreover, a plane 1*b* (see FIG. 2) bisecting the discharge between the electrodes extends parallel to the axis 1*a* of the container and perpendicularly to the discharge stream. It can be assumed that the phenomenon of the stream being thus pulled toward the inside surface of the discharge container 1 results from the creeping discharge occurring along the inside surface.

In addition, as stated above, by appropriately adjusting the resistance values of the limiting resistors 6*a* and 7*a* and the limiting resistors 6*b* and 7*b*, the discharge current for the streamer across the pair of opposed electrodes can be finely adjusted, whereby the "fluctuation" of the streamer of discharge plasma across the pair of opposed electrodes can be suppressed and the streamers across the pair of opposed electrodes can be made uniform.

With the present embodiment, the length of the discharge container 1 along the axis 1*a* of the tube is approx. 10 cm; the spacing between pairs of discharge electrodes is approx. 3 cm; the thickness of the silica glass forming the discharge container 1 is approx. 1 mm; and the outside diameter of the discharge container 1 is approx. 9 mm. In this discharge container 1, a gas mixture consisting of 97% krypton and 3% chlorine is sealed at a pressure of 250 Torr as a discharge gas. The high-frequency voltage supplied by the high-frequency high-voltage power supply 8 is rectangular-wave voltage at 50 to 100 kHz, and the voltage value is 4000 Vpp. With this high-frequency voltage being applied, a stream 5*a* of discharge plasma is generated across the opposed electrodes 3*b* and 4*b*. From the excimer molecules in the stream 5*a*, 5*b*, ultraviolet radiation of 222 nm in wavelength is radiated.

To make the discharge currents across these pairs of opposed electrodes uniform, the resistance values of the limiting resistors inserted to be connected to the respective opposed electrodes are appropriately adjusted, however, such a limiting resistor need not always be provided for each of the opposed electrodes, and with the respective pairs of electrodes, only one of the opposed electrodes may be provided with a limiting resistor to adjust the resistance value. Further, as the geometry of the end portion of the opposed electrodes, it is preferable to provide a geometry which causes the electric field to concentrate locally for suppressing the movement of the streamers 5*a* and 5*b*.

In the above statement, explanation is made by using an application where two sets of pair of opposed electrodes are provided for a discharge container 1, however, for practical use, a number of pairs of opposed electrodes are disposed to be provided for the discharge container 1. In such application, the pairs of opposed electrodes are disposed along the axis of the discharge container 1 at approximately equal intervals. By this, the periodicity of the electric field in the discharge container 1 is maintained, resulting in the electric field being stabilized, and thus the streamers 5*a*, 5*b*, . . . of discharge plasma generated across the respective sets of pair of opposed electrodes being made roughly uniform. Also for this application, the above statements about the way of mounting the opposed electrodes to the discharge container 1, the insertion and connection of the limiting resistors, etc. are applicable.

The thickness of the streamer of discharge plasma depends upon the area of the end portion of the electrode in contact with the discharge container 1. The larger the contact area of the electrode, the thicker the streamer. The quantity of ultraviolet radiation radiated from the streamer depends upon the thickness of the streamer, therefore, to make the intensity distribution of the ultraviolet radiation uniform, it is preferable to provide a uniform contact area for the electrodes.

As explained above, with the present invention, by forming the discharge container cylindrically, and providing a pair of opposed electrodes eccentrically with respect to the axis of the discharge container, the streamer of discharge plasma is stabilized, taking a shape which would be given if it were pulled by the inside surface, and the position of it being fixed. Then, by using the dielectric barrier discharge lamp according to the present invention as the light source to project ultraviolet radiation on the fluorescent screen for a plasma display, the luminance distribution for the fluorescent screen is stabilized with the "fluctuation" being not caused, which allows luminescence performance of the fluorescent screen to be inspected with high accuracy. In addition, the dielectric barrier discharge lamp according to the present invention can be manufactured at a low cost, because the discharge container is cylindrical and simple in shape as stated above. Thus, the present invention can offer a dielectric barrier discharge lamp with which the "fluctuation" in luminance distribution on the ultraviolet radiation receiving surface is minimized, and the structure is simple.

What is claimed is:

1. A dielectric barrier discharge lamp comprising a cylindrical discharge container having a longitudinal axis in which ultraviolet radiation is to be produced, a discharge gas sealed in the discharge container, and a pair of discharge electrodes provided at an outside surface of said discharge container with end portions thereof being in contact with the container, the end portions of two discharge electrodes constituting said pair of electrodes are opposed to each other across a discharge space so that an imaginary line connecting the end portions of the two electrodes is eccentric and does not intersect the longitudinal axis of said discharge container; and a plane passing perpendicular to the line is approximately parallel to the longitudinal axis.

2. A dielectric barrier discharge lamp according to claim 1, wherein a stream of discharge plasma generated across said pair of discharge electrodes forms a shape when viewed from the direction of the axis which disposes it toward an inside wall of said discharge container.

3. A dielectric barrier discharge lamp according to claim 1 or claim 2, wherein a current limiting resistor is inserted in series with said pair of discharge electrodes.

4. A dielectric barrier discharge lamp according to claim 2, wherein a current limiting resistor is inserted in series with said pair of discharge electrodes.

5. The dielectric barrier discharge lamp according to claim 1, including a plurality of said pair of discharge electrodes in contact with the outside surface of said discharge container, each of said plurality of pairs of discharge electrodes being spaced from apart along said longitudinal axis, and each pair of discharge electrodes having said imaginary line which lies in a position offset to the longitudinal axis of the discharge container.

6. The dielectric barrier discharge lamp according to claim 2, wherein the shape of the streamer of discharge plasma is such as is obtained as when the plasma is pulled by the inside surface so that the plasma discharge streamer has an outer shape that is bent toward the inside surface.

* * * * *